US006645599B1

(12) United States Patent
Gabriele

(10) Patent No.: US 6,645,599 B1
(45) **Date of Patent: *Nov. 11, 2003**

(54) DECORATIVE TOWEL ASSEMBLY

(76) Inventor: Rosemarie A. Gabriele, P.O. Box 392, Kure Beach, NC (US) 28449

( * ) Notice: Subject to any disclaimer, the term of this patent is extended or adjusted under 35 U.S.C. 154(b) by 4 days.

This patent is subject to a terminal disclaimer.

(21) Appl. No.: 10/072,685

(22) Filed: Feb. 7, 2002

Related U.S. Application Data

(63) Continuation-in-part of application No. 09/483,479, filed on Jan. 14, 2000, now Pat. No. 6,368,695.

(51) Int. Cl.[7] ..... B32B 3/06

(52) U.S. Cl. ..... 428/88; 428/85; 428/99; 428/100

(58) Field of Search ..... 428/99, 100, 88, 428/85

(56) References Cited

U.S. PATENT DOCUMENTS

| | | | | |
|---|---|---|---|---|
| 2,520,653 A | | 8/1950 | Rand | |
| 3,701,166 A | | 10/1972 | Lindblom | |
| 4,555,435 A | * | 11/1985 | Walter | 428/100 |
| 4,776,043 A | | 10/1988 | Coleman | |
| 4,860,387 A | | 8/1989 | Williams | |
| 5,016,285 A | | 5/1991 | Just | |
| 5,416,928 A | | 5/1995 | Koenig | |
| 5,803,266 A | | 9/1998 | Blackwelder | |
| 6,368,695 B1 | * | 4/2002 | Gabriele | 428/99 |

* cited by examiner

*Primary Examiner*—Alexander S. Thomas
(74) *Attorney, Agent, or Firm*—MacCord Mason PLLC

(57) ABSTRACT

Decorative, non-launderable trim pieces are added to launderable towels with a releasable attachment means so that the trim pieces can be replaced to effect changes in decor. The ability to remove the trim piece prior to laundering of the towel permits the use of materials that would be damaged by laundering. Preferably, the attachment means is a plurality of male fastener components attached to a first flexible support that is secured to the trim strip back, and a plurality of mating female fastener components attached to a second flexible support, that is secured to the surface of the towel.

14 Claims, 3 Drawing Sheets

DECORATIVE TOWEL ASSEMBLY

This application is a continuation-in-part of U.S. patent application Ser. No. 09/483,479, filed Jan. 14, 2000 now U.S. Pat. No. 6,368,695.

BACKGROUND OF THE INVENTION (1) Field of the Invention

The present invention relates generally to towels with decorative trim pieces, and in particular to a towel that includes a detachable, decorative trim, such as a trim strip adjacent one end of the towel.

(2) Description of the Prior Art

Towels for use in the bathroom, whether bath towels or hand towels, are commonly manufactured in a large variety of colors to match the bathroom decor or the personal taste of the homeowner. Additionally, the towels may be printed in a variety of patterns or designs.

Also, especially on higher quality towels, a decorative trim piece such as an elongated trim strip may be added to one surface of the towel. This trim piece may be integrally formed during weaving of the fabric, or may be a separate trim piece that is sewn onto the end of the towel. Sewing of the trim piece onto the towel permits a greater variety of decorative results, since the trim strip can be of a different color, a different material and/or of a different construction. Thus, for example, a satin trim piece can be sewn onto a cotton towel. As another example, a fringed trim strip can be sewn onto the towel edge.

Despite the numerous decorative effects that can be achieved by combining various available colors, designs and trims, there are still decorative effects that cannot be achieved by these techniques. In addition, many homeowners wish to frequently change the decor of their bathrooms.

As a result, the homeowner must keep an inventory of several different towels of different designs, which requires a large storage space, and a substantial financial investment. These space and investment requirements can be even greater if the homeowner wishes to have an inventory of different decorative bathroom ensembles that include both bath and hand towels, as well as washcloths, bath rugs, etc.

Thus, there is a need for an additional means for providing towels, and bathroom ensembles including towels, that offers the homeowner a greater variety of decorative alternatives.

SUMMARY OF THE INVENTION

The present invention is directed to decorative towels, and to bathroom ensembles including decorative towels. In particular, the invention relates to bathroom towels that include replaceable decorative trim pieces, especially a replaceable decorative trim strip adjacent one edge of the towel. The term "trim piece" as used herein designates a decorative object having a back surface that is attached to a towel surface. While these trim pieces will be exemplified herein by an elongated strip, it will be understood that other shapes of trim pieces can be used, such as designs for animals, flowers, seashells, etc. Also, while the trim piece will normally include a textile or fabric component, other materials may be used to construct all or a part of the trim piece.

The decorative towel assemblies of the present invention are comprised of a towel, a decorative trim piece, and a means for releasibly attaching the trim piece to one surface of the towel. For example, the towel may be a rectangular bath towel with a releasable decorative trim strip attached adjacent an end of the towel. The towel can be of conventional, known material, such as a woven cotton fabric, or other textile material, such as knitted fabrics. The term "cotton fabric" is intended to include 100% cotton, as well as blends of cotton with other fibers, such as rayon or polyester. Alternatively, the towel can be made of linen. The fabric may be of different fibers and weaves, including combed cotton, looped or sheared pile fabrics, and terry-cloth. The yarn used in preparation of the fabric may be combed or carded. Also, the fabric can be white or colored, and can be plain or printed with a pattern or design.

The fabric can be of different dimensions and shapes, depending upon the decorative theme, and whether the towel is a bath towel, a hand towel, or a finger towel. If a rectangular bath towel, the fabric will normally be from 24 to about 36 inches in width, more often about 26 to 32 inches in width, and from about 44 to about 60 inches in length, more often from about 48 to about 54 inches in length. If a rectangular hand towel, the fabric will normally be from about 16 to about 20 inches in width, and from about 26 or 28 to about 32 inches in length. If a finger towel, the fabric will normally be from about 8 to about 13 inches in width and from about 13 to about 20 inches in length. The fabric will normally be hemmed along both its side and end edges to prevent raveling. Instead of rectangular, the towel may be round, hexagonal, or other shape. The decorative trim piece can be made of a great variety of designs, and can be of one or more materials which are the same as, or different from, the towel fabric.

Unlike the trim pieces on prior art decorative towels, the decorative trim pieces of the present invention may be detached from the towel before the towel is laundered. Therefore, the trim strip or other trim piece can be of a fabric or a material that would not withstand the conditions to which towels are normally subjected during laundering. These materials, referred to herein as non-launderable, include not only materials that would be essentially destroyed by the heat and conditions of laundering, but also materials that would be damaged in construction or appearance. For example, the trim piece can be formed of wholly or partially of fur, or of a heat sensitive material, such as silk. Other materials include feathers, rhinestones and beads. Also, the trim piece can be knitted, or include fringe that might become entangled during the rigors of laundering.

The exact construction and design of the trim piece of the preferred embodiment will depend largely upon the decorative appearance sought. When in the form of a strip, the length of the trim strip in most instances will be substantially equal to the width of the towel fabric to which the strip is attached, so that the strip extends from one side of the towel fabric to the other. The width of the trim strip will vary depending on the design.

Generally, the strip will extend at least slightly above and below the area of attachment to the towel, so that the releasable attachment means is not readily visible. In some designs, such as those with fringe, the bottom edge of the trim strip will be positioned approximately adjacent the lower edge of the towel fabric, while in other designs, the lower edge of the strip will be spaced above the lower edge of the towel.

The decorative trim strip or other trim piece may be releasibly attached to the towel fabric in various ways. For example, a section of hook and loop fasteners can be secured to one face of the towel fabric, with the mating section of hook and loop fastener material being secured to the inner face of the trim strip. Clips, buttons or a zipper can also be used to releasibly attach the two components. Other releasable attachment means will be apparent to ones skilled in the art after reading the present disclosure.

Certain requirements must be considered, however, in selecting the attachment means. First, the part of the attachment means secured to the towel fabric must be launderable. That is, the means on the towel fabric must not distort or lose its attachment properties when subjected to heat and water during laundering. Also, the attachment means must be easily covered when the decorative towel is assembled to hide the attachment means from view. Importantly, the attachment means must not contain parts that would be abrasive to the user's skin when the towel is used.

Taking into account these requirements, it has been found that the preferred means for attaching the trim piece and towel fabric is through the use of snap fasteners comprised of mating male and female fastener components. The male fastener components may be attached to the trim piece, with the female fastener components being attached to the towel fabric. Alternatively, the female fastener components may be attached to the trim piece, with the male fastener components being attached to the towel fabric. When attaching a trim piece, the fastener components will normally be equally spaced at a distance of from about 1 or 2 to about 6 inches apart.

For ease of positioning, the male fastener components are preferably attached to the face of a flexible support, such as a flexible tape, with the female fastener components being attached to the face of another flexible support. The support may be of various materials including plastic or woven fabric. One support, preferably the support with the female fasteners, is then attached to the outer face of the towel fabric. If the support is in the form of a tape, the tape may be attached parallel of one of the fabric ends. The other support, if a tape, is then attached to the inner face of the trim strip parallel to the trim strip edges. The tapes may be attached by various means, including sewing and with an adhesive.

As noted earlier, the decorative towels of the present invention may form a part of a coordinated bathroom ensemble comprised of bath towels, hand towels, washcloths, and other components such as throw rugs and toilet seat covers. Both the bath towels and hand towels may include releasable trim pieces, or the decorative trim pieces may be used on only one kind of towel. The term "coordinated bathroom ensemble" is intended to designate a group of items that through their overall design, trimmings and/or colors, provide a common theme or appearance. It is not necessary for this purpose that all of the components are of the same color, or have the same trim, or are even of the same design.

Accordingly, one aspect of the present invention is to provide a decorative towel assembly that is comprised of a towel, a decorative trim piece, and an attachment means for releasibly attaching the trim piece to one surface of the fabric.

Another aspect of the present invention is to provide a bathroom ensemble that is comprised of at least one decorative towel assembly of the above construction, and at least one item selected from the group consisting of a bath mat, a hand towel, a finger towel, and a toilet seat cover.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
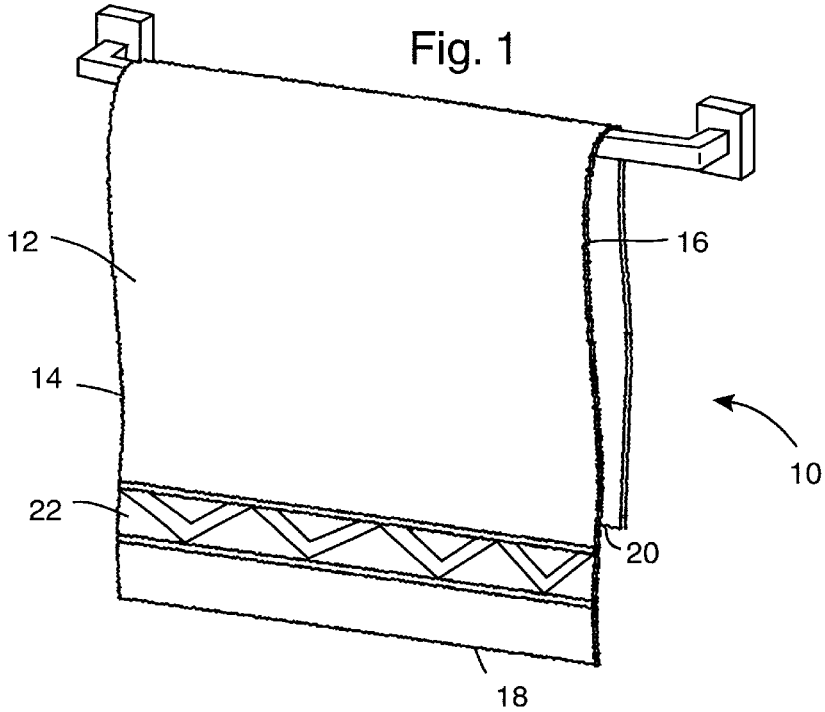
FIG. 1 is a perspective view of a decorative towel assembly of the present invention.
Figure 3:
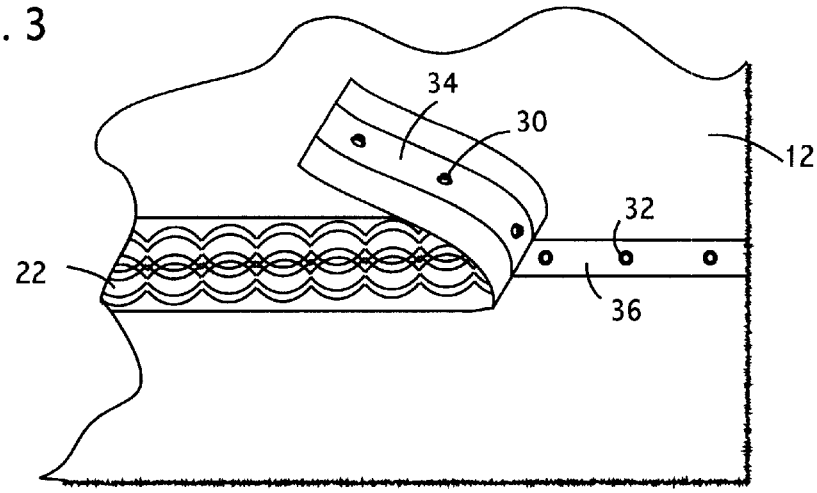
FIG. 3 is a detailed view of the lower edge of a decorative towel assembly showing the various components with a corded trim.
Figure 4:
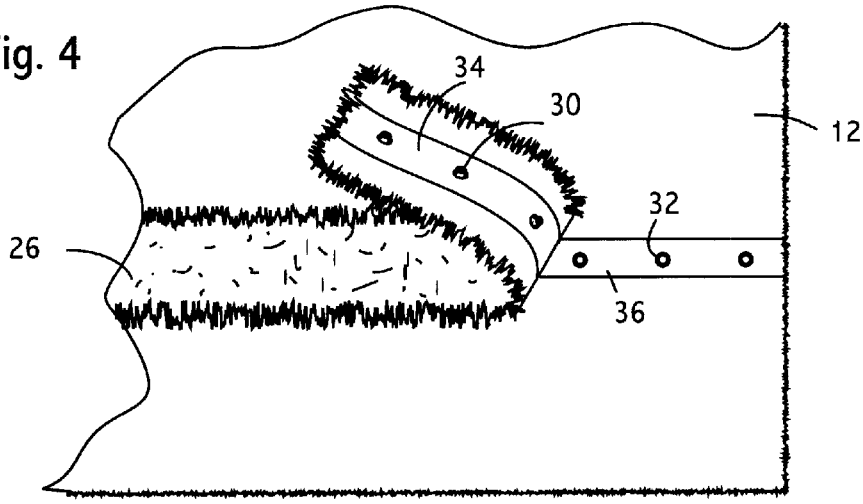
FIG. 4 is a detailed view of the lower edge of a decorative towel assembly showing the various components with a fur trim.
Figure 5:
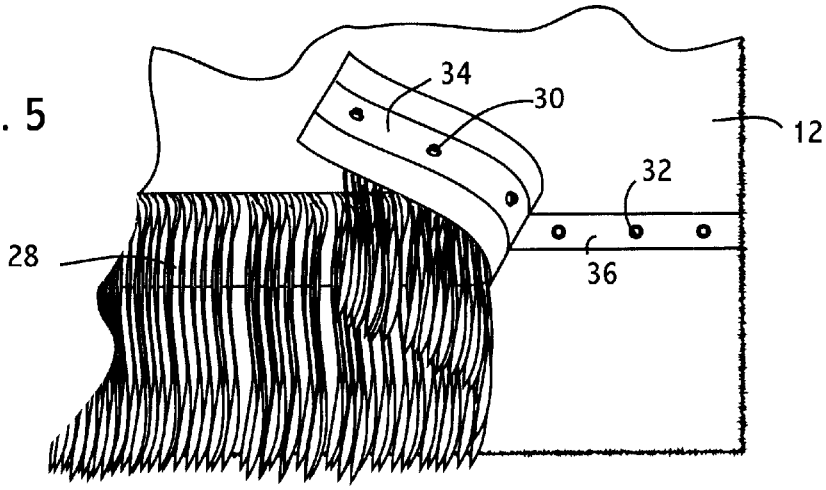
FIG. 5 is a detailed view of the lower edge of a decorative towel assembly showing the various components with a fringed trim.

As illustrated in the FIG. 1, decorative towel assembly 10 is comprised of a rectangular towel 12 having opposed parallel side edges 14 and 16, and end edges 18 and 20, and a decorative trim strip 22 releasibly attached to the outer face of towel 12 adjacent and parallel to an end edge 18. FIGS. 3, 4 and 5 illustrate alternative trim strips. Specifically, strip 24 is a corded strip, strip 26 is a fur strip, e.g., a strip of mink, and strip 28 is a tasseled or fringed strip with the lower ends of the fringe terminating at end edge 18 of towel 12.

As illustrated in FIGS. 3, 4 and 5, the trim strip is attached to towel 12 with a plurality of equidistant snap fasteners comprised of a male fastener component 30 and a mating female snap fastener component 32. Components 30 are mounted on a first tape 34 that is attached to a back surface the trim strip, and components 32 are mounted on a second tape 36 that is attached to the front surface of towel 12.

Figure 2:
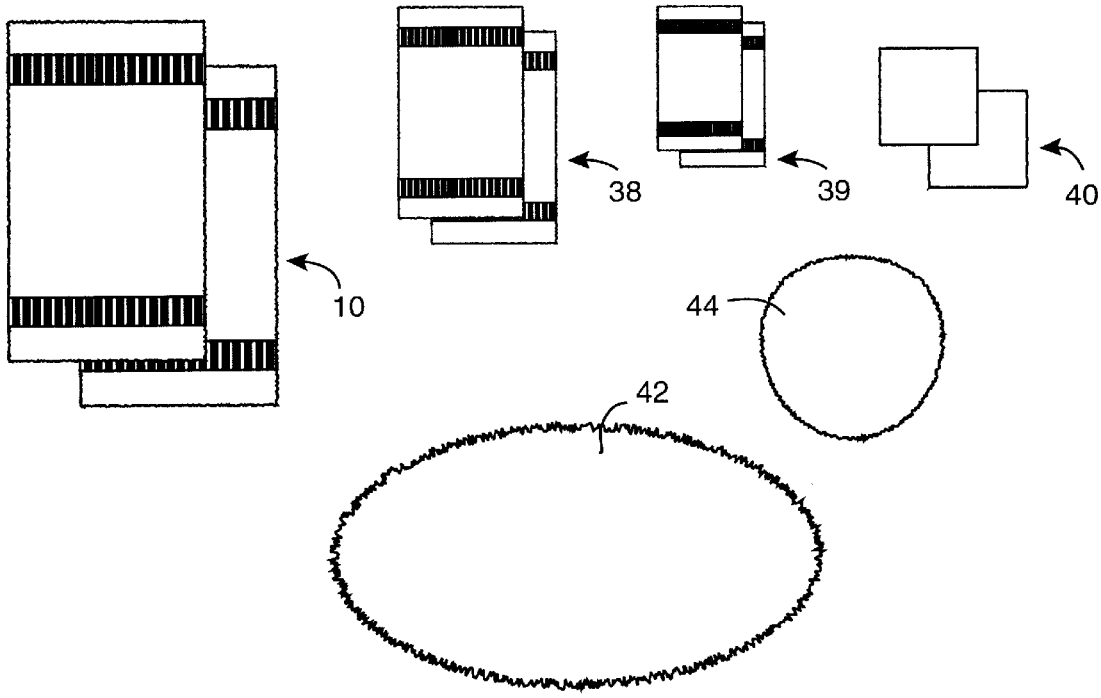
FIG. 2 is an illustration of a bathroom ensemble including bath towels and hand towels with releasable decorative trim.

FIG. 2 illustrates a bathroom ensemble that includes towels 10, hand towels 38 and finger towels 39, either or both of which may also include a detachable trim strip, washcloths 40, a rug 42, and a toilet seat cover 44.

Figure 6:
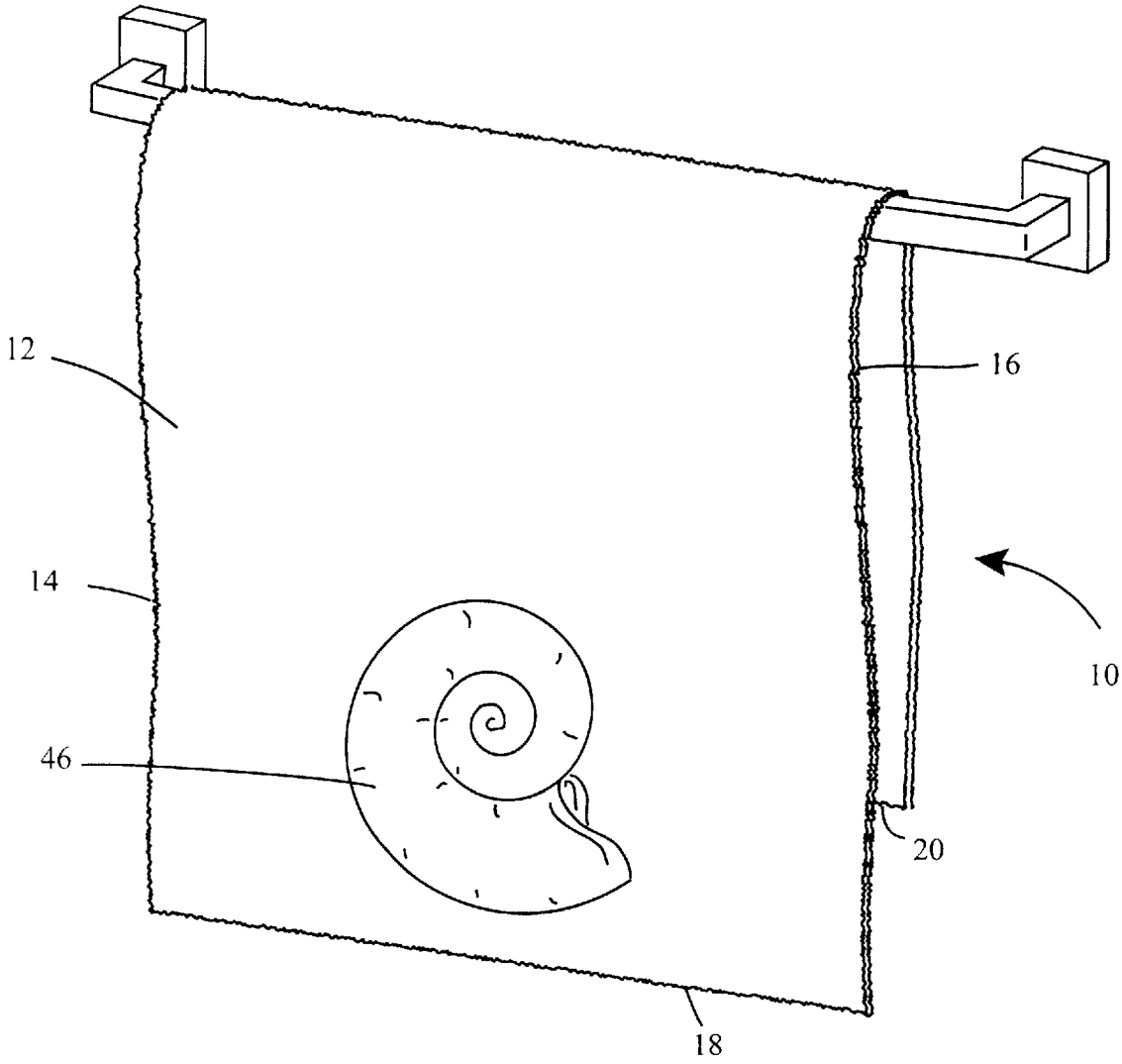
FIG. 6 is a perspective view of a bath towel with another type of releasable trim piece.

FIG. 6 illustrates a towel 10 with another type of releasable trim piece. While a seashell 46 is shown, it should be understood that the exact shape and placement of the indicia is a matter of personal choice.

With the present invention, the homeowner may purchase a single set of towel assemblies 10, and one or more sets of trim pieces of different designs and/or colors. Then, when a different decor is desired, the homeowner simply unsnaps the initial trim pieces from the towel, and snaps on different trim pieces to give an entirely different appearance. The ability to remove the trim pieces prior to laundering also preserves the trim pieces, and permits the use of materials not previously useful as towel trim.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A decorative towel assembly for use in a bathroom comprising:

a) a launderable cotton, cotton blend, or linen towel having opposed surfaces, a given width and an edge, said towel being selected from the group consisting of a bath towel having a width of from about 24 to about 36 inches and a length of from about 44 to about 60 inches, a hand towel having a width of from about 16 to about 20 inches and a length of from about 26 to about 32 inches, and a finger towel having a width of from about 8 to about 13 inches and a length of from about 13 to about 20 inches;

b) a non-launderable decorative trim piece; and c) a releasable attachment means to secure said trim piece to one surface of said towel.

2. The towel assembly of claim 1, wherein said towel is of woven cotton.

3. The towel assembly of claim 1, wherein said trim piece is a strip releasibly attached parallel to an edge of said towel.

4. The towel assembly of claim 1, wherein said releasable attachment means is a plurality of snap fasteners.

5. The towel assembly of claim 1, wherein said towel is rectangular with opposed side edges and opposed end edges, and said decorative trim is an elongated strip attached parallel to and spaced from an end edge of said towel.

6. The towel assembly of claim 1, wherein said trim piece includes feathers, rhinestones, or beads.

7. The towel assembly of claim 1, wherein said trim piece is fringed.

8. A decorative towel assembly for use in a bathroom comprising:

a) a launderable cotton, cotton blend, or linen towel having opposed surfaces, a given width and an edge, said towel being selected from the group consisting of a bath towel having a width of from about 24 to about 36 inches and a length of from about 44 to about 60 inches, a hand towel having a width of from about 16 to about 20 inches and a length of from about 26 to about 32 inches, and a finger towel having a width of from about 8 to about 13 inches and a length of from about 13 to about 20 inches;

b) a non-launderable decorative trim piece having front and back surfaces; and c) a releasable attachment means to secure said trim piece to one surface of said towel, said attachment means including a plurality of male fastener components attached to a first tape, and a plurality of mating female fastener components attached to a second tape, one of said tapes being attached to a surface of said towel, and the other of said tapes being attached to the back surface of said trim piece.

9. The towel of claim 8, wherein said trim piece is a strip having a length approximately equal to said towel given width.

10. The towel assembly of claim 8, wherein said trim strip has a fringed front surface.

11. A bath ensemble comprising:

a) at least one decorative finger towel assembly formed of a launderable towel made of cotton, a cotton blend, or linen, said towel having opposed surfaces, a given width and an edge; a non-launderable decorative trim piece; and a releasable attachment means to secure said trim piece to one surface of said towel; and b) at least one item selected from the group consisting of at least one hand towel, at least one wash cloth, at least one bath towel, at least one bath rug, and at least one toilet seat cover.

12. The towel assembly of claim 11, wherein said bath towel has a width of from about 24 to about 36 inches, and a length of from about 44 to about 60 inches.

13. The towel assembly of claim 11, wherein said hand towel has a width of from about 16 to about 20 inches, and a length of from about 26 to about 32 inches, and includes a detachable, non-launderable decorative trim.

14. The towel assembly of claim 11, wherein said finger towel has a width of from about 8 to about 13 inches, and a length of from about 13 to about 20 inches, and includes a detachable, non-launderable decorative trim.

* * * * *